United States Patent [19]

Julien

[11] Patent Number: 4,825,788

[45] Date of Patent: May 2, 1989

[54] METHOD AND APPARATUS FOR AUTOMATICALLY MATCHING TWO CORNERS OF PIECES OF FABRIC, AND INSERTING THEM INTO A SEWING MACHINE

[75] Inventor: Michel Julien, St Andre les Vergers, France

[73] Assignee: Institut Textile de France, Boulogne Billancourt Cedex, France

[21] Appl. No.: 104,832

[22] Filed: Oct. 2, 1987

[30] Foreign Application Priority Data

Oct. 3, 1986 [FR] France ..... 86 13831

[51] Int. Cl.[4] ..... D05B 97/00; D05B 35/10; D05B 27/06

[52] U.S. Cl. ..... 112/262.3; 112/153; 112/121.12; 112/121.26; 112/306; 112/311

[58] Field of Search ..... 112/262.3, 153, 152, 112/121.11, 121.12, 121.15, 121.26, 306, 305, 311, DIG. 2, DIG. 3

[56] References Cited

U.S. PATENT DOCUMENTS

| | | | |
|---|---|---|---|
| 3,782,310 | 1/1974 | Stockel | 112/153 |
| 3,867,889 | 2/1975 | Conner, Jr. | 112/121.11 |
| 4,036,156 | 7/1977 | Becker et al. | 112/121.26 |
| 4,037,546 | 7/1977 | Kleinschmidt | 112/121.26 |
| 4,133,279 | 1/1979 | Wajcmann | 112/153 |
| 4,590,876 | 5/1986 | Mencke et al. | 112/153 |

*Primary Examiner*—H. Hampton Hunter
*Attorney, Agent, or Firm*—Shenier & O'Connor

[57] ABSTRACT

The invention consists in manually inserting a first piece of fabric (49) into the bottom portion of an edge guide comprising three superposed plates (2, 3, 4). The piece of fabric is pushed towards the end of the edge guide by means of jets of air until the side (51) of the piece along which sewing is to be performed is aligned with an end abutment. A dog (17) placed beneath the bottom plate (2) presses the piece of fabric (49) against the bottom face of the middle plate (3) and then displaces it along the sewing line direction until the other side (52) of the corner has reached a reference line (53). A second piece of fabric (54) is manually inserted and is positioned in the same way as the first by means of a dog (18) placed above the top plate (4). Once both of the pieces of fabric (49 and 54) are exactly superposed, the dogs (17, 18) drive them simultaneously at the same speed under the presser foot (47) of the sewing machine.

7 Claims, 5 Drawing Sheets

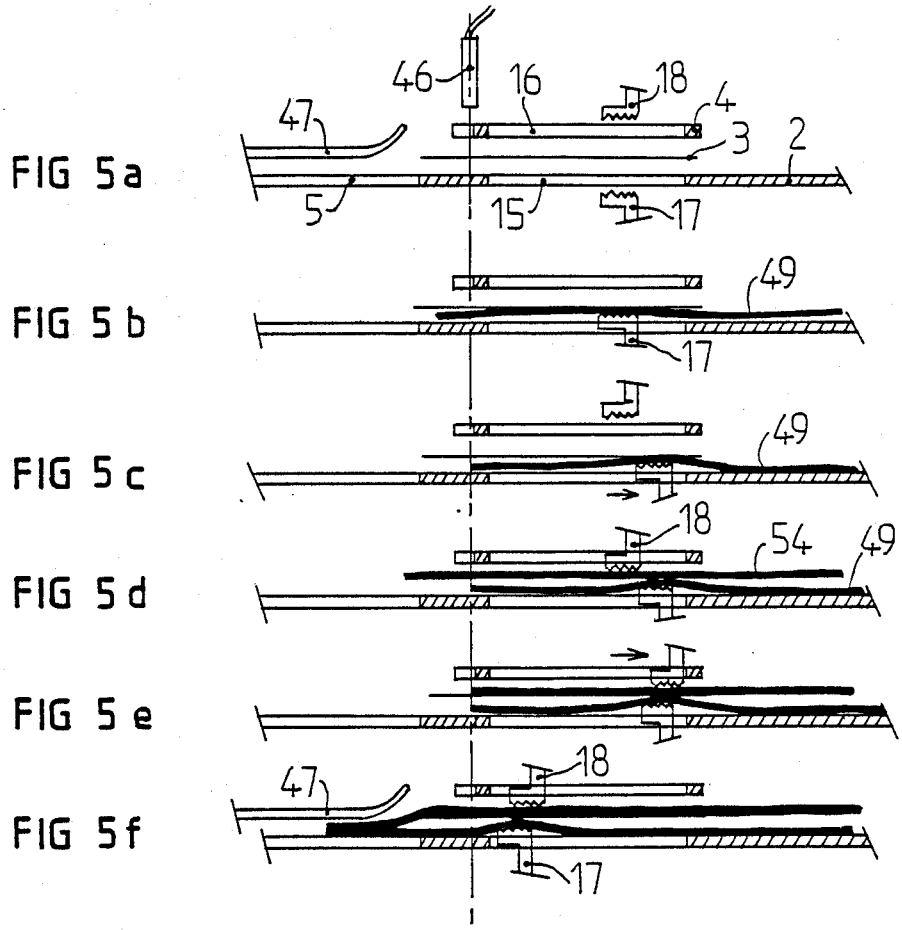
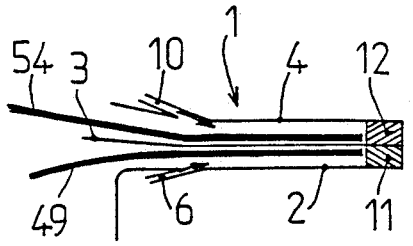
FIG 6
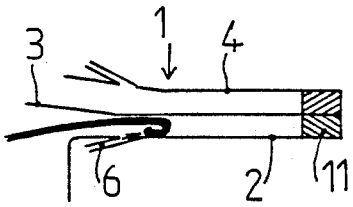
FIG 7

METHOD AND APPARATUS FOR AUTOMATICALLY MATCHING TWO CORNERS OF PIECES OF FABRIC, AND INSERTING THEM INTO A SEWING MACHINE

The present invention relates to automatically inserting two pieces of fabric under the presser foot of a sewing machine, and more particularly to inserting two superposed pieces after two corresponding corners have been matched. The invention relates particularly to making up textile articles, but it extends more generally to any field in which it is necessary to accurately superpose and assemble two flexible pieces.

BACKGROUND OF THE INVENTION

A frequent operation when making up textile articles consists in assembling two pieces of fabric along their edges, and this operation requires two corners from which sewing is to begin to be matched initially. The superposing of two pieces and the putting into co-incidence of both sides of the corners over lengths of a few centimeters are manipulation operations that are difficult and whose duration increases with the complexity involved in grasping each piece. For example, with a jersey knit, matching often begins by unrolling the edges. Once their corners have been matched, the two superposed pieces are brought to and inserted under the presser foot of the sewing machine. All of these "pre-sewing" operations are performed manually and require a great deal of accuracy and practice on the part of the operator.

The present invention concerns a method which has been discovered of assisting an operator to automatically provide exact matching of two corners and to insert the two superposed pieces under the presser foot of the sewing machine, starting from two pieces which are approximately superposed by hand and which are positioned approximately in the vicinity of the corners concerned.

SUMMARY OF THE INVENTION

The method of the present invention comprises the following steps:

a. the first piece, is inserted manually over a first slide surface coplanar with the working plane of the sewing machine, and is pushed by first thrust means up to a first rectilinear abutment which is parallel to the sewing line and which is slightly beyond said line;

b. once that side of the corner along which sewing is to take place has been positioned against the first abutment, first displacement means press against the first piece and displace it by sliding over the first slide surface along a direction parallel to the sewing line until the other side of the angle in the first piece has reached a predetermined reference line;

c. the second piece is inserted manually over a second slide surface whose plane is parallel to and lies above the first slide surface, the piece is pushed by second thrust means until it reaches a second rectilinear abutment situated in the same vertical plane as the first abutment;

d. once that side of the corner along which sewing is to take place has been positioned against the second abutment, second displacement means press against the second piece and displace it by sliding over the second slide surface along a direction parallel to the sewing line, until the other side of the corner of the second piece reaches the predetermined reference line; and e. with both pieces superposed in this way, they are simultaneously displaced by the first and second displacement means and are inserted beneath the presser foot of the sewing machine.

Thus, all the operator needs to do is manually insert the first piece (step a) and then the second piece (step c) over each of the corresponding slide surfaces, with the pieces being approximately positioned in the vicinity of the corners concerned. The first piece is accurately positioned initially with the side of the corner along which sewing is to take place running along the first abutment, and then with the other side of the corner running along the reference line. The same positioning operation is then performed with the second piece and then the two exactly superposed pieces are displaced simultaneously and are inserted beneath the presser foot of the sewing machine.

The method in accordance with the invention makes it possible to perform some of the work in overlapping time, insofar as the operator prepares and inserts the second piece while the first piece is being positioned during steps a and b.

The term "rectilinear abutment" used above should be understood in a wide sense: it comprises means along which the piece terminates its displacement. This may, in fact, be an abutment in the normal sense of the word, i.e. solid means against which the side of the piece is constrained to come to rest. However, in accordance with the method of the invention, it may also be incorporeal means, e.g. a reference line along which the side of the piece is positioned. In the first case, the thrust means have the sole function of thrusting the piece towards the abutment. In the second case, the thrust means have the additional function of stopping the piece along the reference line constituting the abutment.

The invention also provides apparatus specifically designed for implementing the above method. This apparatus comprises the following items:

a. a first slide plate which is coplanar with the working plane of the sewing machine and on which a first rectilinear abutment is placed parallel to the sewing line and slightly beyond said line;

b. a second slide plate whose plane is parallel to and lies above the first slide plate, and on which a second rectilinear abutment is placed in the same vertical plane as the first abutment;

c. two sets of thrust means, each set being associated with a respective one of the slide surfaces and being capable of displacing a piece of fabric up to the corresponding abutment; and d. two sets of displacement means each set being capable of displacing a respective one of the pieces of fabric in a direction parallel to the sewing line, initially up to a reference line, and subsequently up to the presser foot of the sewing machine, by sliding the pieces of fabric over the bottom face and the top face respectively of the second slide plate.

Preferably, the thrust means are pneumatic means comprising nozzles fed with compressed air and inclined in the direction along which the piece of fabric is to be thrust.

Preferably, each set of displacement means comprises:

a. a dog;

b. a dog drive device capable of communicating thereto both a vertical motion between a first position in which the dog is at a distance from the second slide plate and a second position in which the dog is in contact with said plate, and a horizontal motion along the direction of the sewing line; and c. means for detecting a piece of fabric as it moves over the second slide plate, said means acting on the drive device in such a manner as to prevent it from driving the piece of fabric any further once its corresponding side has reached the reference line.

Further, each drive device is connected to synchronizing means for causing both dogs to move simultaneously and at the same speed along the direction of the sewing line through a distance equal to the distance between the reference line and the underside of the presser foot of the sewing machine.

In a preferred embodiment, the apparatus in accordance with the invention includes a third slide plate extending substantially parallel to the working plane and situated above the second slide plate, and in that the thrust means comprise orifices through the first slide plate and through said third slide plate.

On their sides facing away from the abutment, the second and third plates are slightly upwardly curved in order to facilitate inserting the pieces into the appropriate gaps, with the first piece being inserted between the first and second plates and with the second piece being inserted between the second and third plates.

BRIEF DESCRIPTION OF THE DRAWINGS

The invention will be better understood from the following description of the preferred embodiment made with reference to the accompanying drawings, in which:

FIGS. 5*a* to 5*f* are diagrammatic sections along the sewing line during different stages of operation;

FIG. 6 shows the position taken up by two pieces between the plates; and

FIG. 7 illustrates the jersey knit case.

DESCRIPTION OF PREFERRED EMBODIMENT

Figure 1:
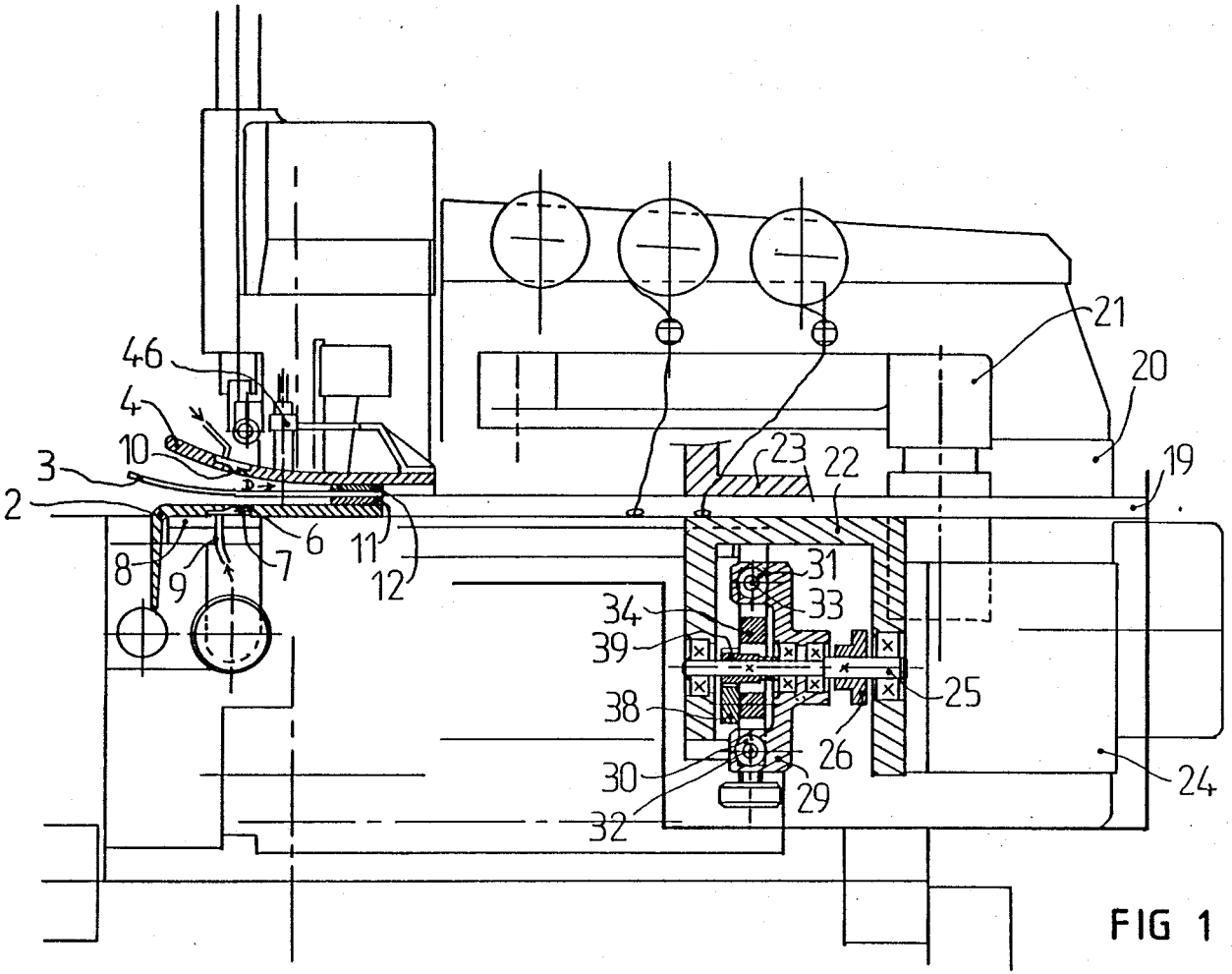
FIG. 1 is a section through the apparatus transversely to the sewing line.
Figure 2:
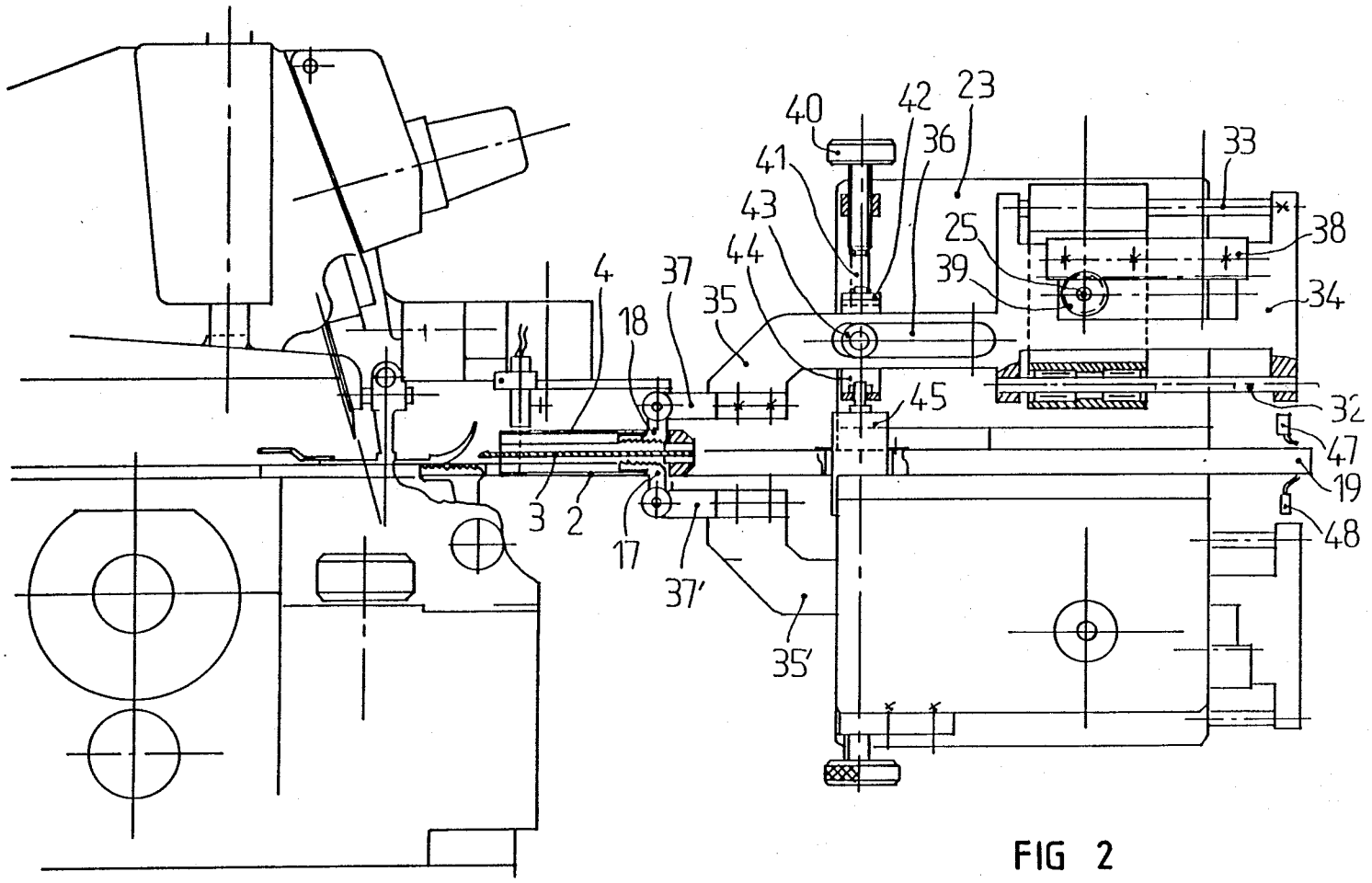
FIG. 2 is a section through the apparatus along the sewing line.
Figure 3:
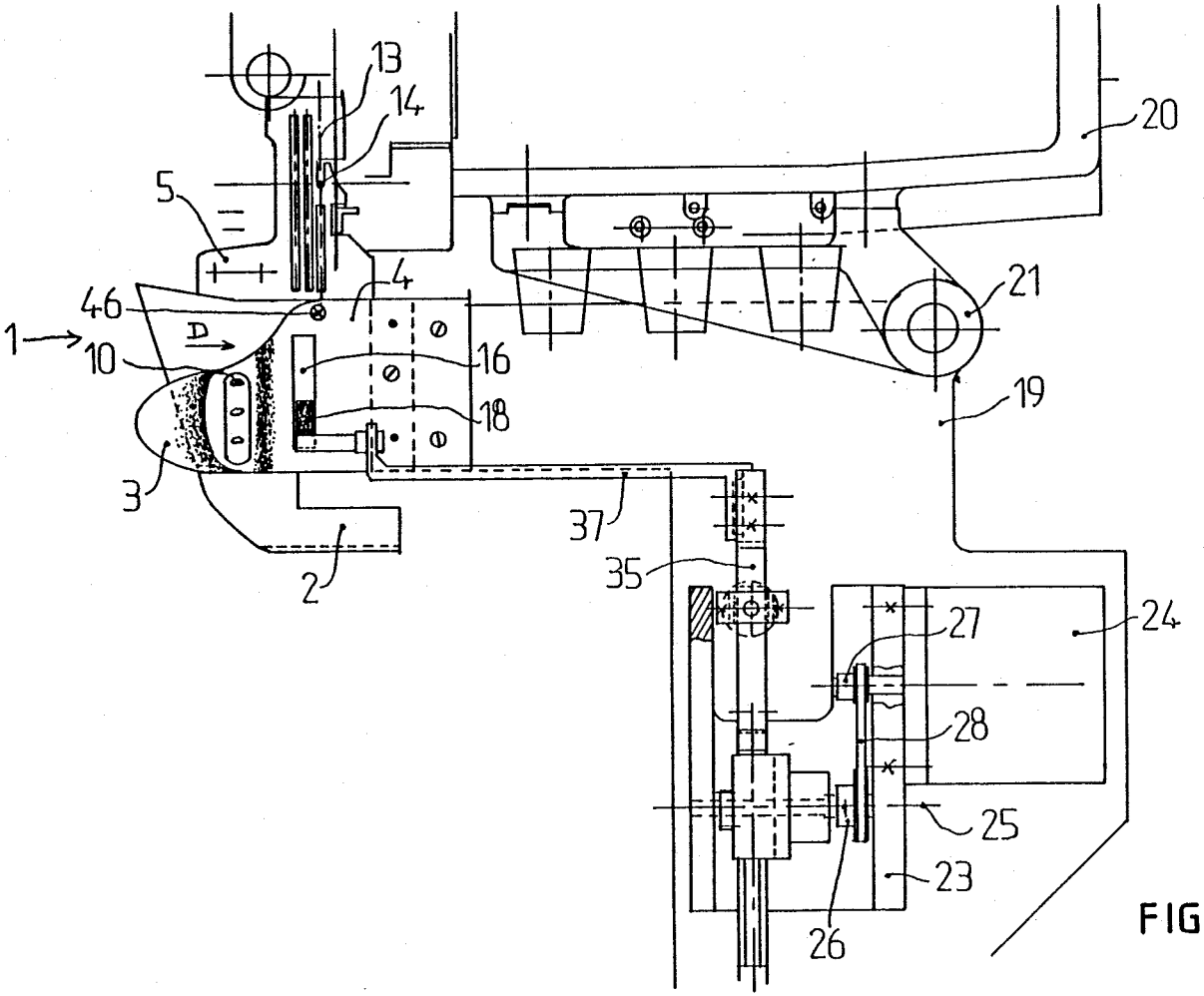
FIG. 3 is a plan view of the apparatus.

The edge-guide 1 comprises three superposed plates 2, 3, and 4. The bottom plate 2 is placed in front of the needle plate 5 in such a manner that the top faces of these two plates 2 and 5 are coplanar. It includes a plurality of orifices 6 which are inclined relative to the horizontal plane and which open out into a housing 7 made within the plate 2 itself; said housing 7 being closed by a small plate 8 having a compressed air delivery inlet 9 fixed therethrough. The top plate 4 also has orifices 10 supplied with compressed air in the same way as the orifices 6. In both cases, the orifices 6 and 10 are oriented substantially along the direction of arrow D. The plates 2 and 4 are separated from the intermediate plate 3 by means of spacers 11 and 12 which constitute the abutments at the back of the guide. The inside portions of the spacers 11 and 12 constituting the abutments lie in the same vertical plane which extends parallel to the sewing line 13 which passes through the needle 14.

Each of the plates 2 and 4 is partially hollowed out along a slot 15 or 16, as the case may be, with a corresponding dog 17 or 18 located therein. The slots 15 and 16 allow their dogs 17 and 18 to move horizontally along the sewing line 13. Each dog 17 and 18 is connected to a corresponding drive device enabling the dog to move both vertically and horizontally. The drive devices are constituted by components described below.

Two identical brackets 22 and 23 are fixed on a plate 19 which is fixed to the frame of the sewing machine 20 by means of a vertical axis hinge 21. Each bracket receives components for displacing one of the dogs, with the bottom bracket 22 receiving components corresponding to the bottom dog 17 and the top bracket 23 receiving components corresponding to the top dog 18. The bracket 22 supports both a stepper motor 24 and a rotary shaft 25. A pulley wheel 26 is fixed to the shaft 25 and is connected to a pulley wheel 27 on the motor 24 by means of a toothed belt 28. A support part 29 is hinged about the shaft 25. It has two guide shaft holes 30 and 31 slidably receiving the shafts 32 and 33 fixed to a mechanism 34. The mechanism 34 includes an arm 35 having a support 37 for the dog 18 at the end thereof, and a rack 38 which meshes with a gearwheel 39 fixed on the shaft 25. A spring 41 and an adjusting screw 40 fixed to the bracket 23 serve to apply an adjustable pressure on the arm 35 via a part 42 carrying a wheel 43 which is received inside a slot 36 in the arm 35. This disposition makes it possible to displace the arm 35 while maintaining the action of the spring 41.

The bottom portion 44 of the part 42 receives the end of an actuator rod, belonging to an actuator 45 which is fixed to the plate 19. The edge-guide 1 is fixed to the end of the plate 19. Thus, the entire apparatus is retractable by pivoting about the shaft 21 in order to provide access to the parts of the sewing machine. A locking screw (not shown) serves to fix the assembled apparatus in position.

A photocell 46 is placed above the edge-guide 1 and ahead of the presser foot 47 of the sewing machine. The working axis of the cell 46 is vertical and the plates 3 and 4 have holes to pass a light beam. The photocell 46 is connected to the stepper motor 24. Two proximity detectors 47 and 48 located beneath the mechanism 34 are also connected to the stepper motor 24.

Figure 4A:
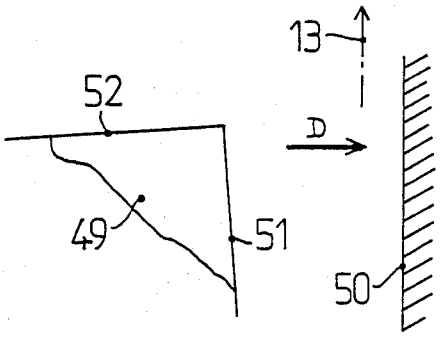
FIGS. 4*a* to 4*e* are diagrammatic plan views of different stages of operation.
Figure 4B:
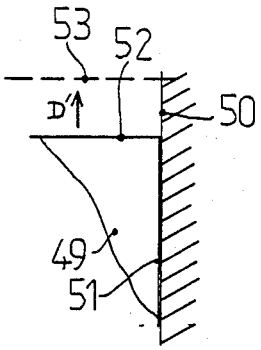
Figure 4C:
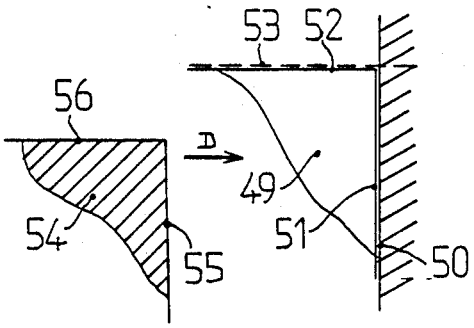
Figure 4D:
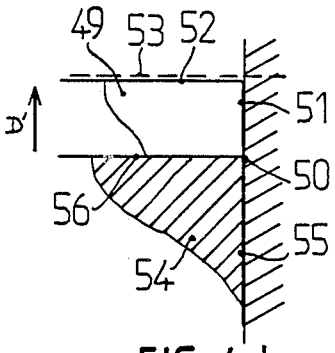
Figure 4E:
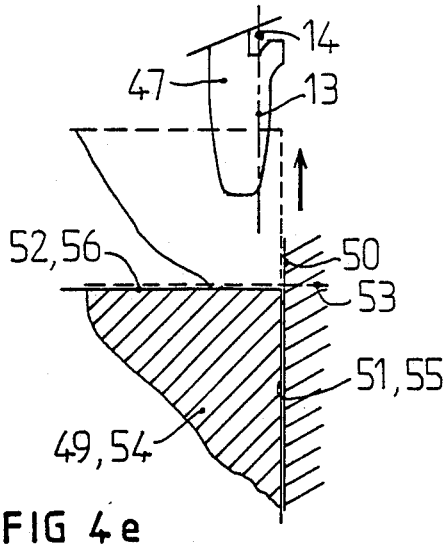

We begin by describing the sequence of steps in the method in general terms with reference to the diagrams of FIGS. 4*a* to 4*e*. The first piece of fabric 49 is inserted manually by the operator approximately into position. It is pushed towards the abutment line 50 along arrow D transversely to the sewing line 13 (see FIG. 4*a*). Once the side 51 along which sewing is to take place is positioned exactly along the abutment line 50, the first piece 49 is moved along arrow D' (see FIG. 4*b*) until the other side 52 of the corner has reached reference line 53 (see FIG. 4*c*). While this is taking place, the operator manually inserts the second piece of fabric 54 approximately into position. This second piece 54 is likewise thrust along the direction of arrow D (FIG. 4*c*) until the side 55 along which sewing is to be performed is exactly in position along the abutment line 50, and then it is moved along D' (FIG. 4*d*) until the other side 56 has reached the reference line 53. Thus, the two pieces of fabric 49 and 54 have respective sides 51 and 55 and 52 and 56 aligned along common lines 50 and 53. These two pieces are thus exactly superposed. Both pieces are then moved simultaneously and at the same speed along direction D' to be inserted beneath the presser foot 47 of the sewing machine.

More precisely, the operation of the apparatus as described above takes place as follows. Prior to inserting the first piece of fabric, the dogs 17 and 18 are in their high positions lying outside the slots 15 and 16 through the plates 2 and 4 (FIG. 5*a*). The operator manually inserts the first piece 49 between the plates 2 and 3 while compressed air is being fed through the orifices 6 to push the piece 49 to the end of the guide 1 against the abutment 11. The action of the jets of compressed air is maintained throughout the following operations, including sewing. The piece 49 obstructs the photocell 46. The operator presses on a control pedal, thereby causing actuator 45' to retract (with the actuator 45' acting on the bracket 22 beneath the plate 19 and corresponding to the actuator 45 for the bracket 23). The retraction of the actuator 45' applies the dog 17 onto the piece 49 against the bottom face of the intermediate plate 3. The piece is thus clamped between the dog 17 and the plate 3 (FIG. 5*b*). Then, after a time delay, the stepper motor 24' is started and drives the dog 17 until the piece 49 ceases to obstruct the cell 46 (FIG. 5*c*). The side 52 of the piece 49 is then positioned along the reference line 53.

The dog 17 is driven by rotation of the stepper motor 24' as follows. The pulley 27' on the motor 24' rotates the shaft 25' by means of the toothed belt 28' and the pulley wheel 26'. The gearwheel 39' mounted on the shaft 25' rotates and displaces the rack 38' and consequently displaces the mechanism 34', the support 37', and thus the dog 17. The mechanism 34' is kept horizontal during its displacement by the guide shafts 32' and 33' passing through the guide shaft holes 30' and 31'.

The same operations are performed to position the second piece of fabric 54. The operator manually inserts this piece 54 between the two plates 3 and 4 of the edge guide 1. The jets of air leaving the orifices 10 push the piece 54 against the abutment 12 at the end of the guide. The photocell 46 is thus obstructed a further time. The operator presses on the control pedal and causes the actuator 45 to retract and lower the dog 18 against the top face of the intermediate plate 3 (FIG. 5*d*). After a time delay, the dog 18 is moved by the stepper motor 24, thereby driving the piece 54 until the cell 46 is no longer obstructed (FIG. 5*e*). The side 56 of the piece 54 is then in position along the reference line 53 and the two pieces 49 and 54 are exactly superposed.

As soon as the cell 46 is no longer obstructed, both stepper motors 24 and 24' turn through a predetermined number of steps in the opposite direction to their previous direction of rotation, thereby simultaneously displacing the two dogs 17 and 18 at the same speed towards the presser foot 47. The number of steps is fixed as a function of the distance between the reference line 53 as indicated by the cell 46 and the bottom of the presser foot 47. As a result, both pieces are inserted in exact superposition beneath the presser foot 47 (FIG. 5*f*). Thereafter, the actuators 45 and 45' retract moving the dogs 17 and 18 back to their initial positions (FIG. 5*a*) as determined by proximity detectors 47 and 48.

When the pieces of fabric have edges which tend to roll up, as is the case in particular of jersey knits, the jets of air from the orifices 6 serve not only to push the knit towards the abutment 11 at the end of the guide 1, but also serve to unroll the leading edge before it reaches the end of the guide (FIG. 7).

The above description corresponds to using apparatus in accordance with the invention to assist an operator when automatically matching two corners in pieces of fabric and inserting them into a sewing machine. The apparatus may also constitute an item of automation in a more complex machine. By way of example, mention may be made of simultaneously sewing two sides of a garment by means of two sewing machines each equipped with apparatus in accordance with the invention.

I claim:

1. A method for automatically matching the corners of two pieces of fabric adapted to be sewed along a sewing line parallel to one side of said corners and for inserting the pieces in a sewing machine having a working plane and a presser foot, said method comprising the steps of:

a. manually placing a first piece of fabric on a first slide surface coplanar with the working plane of the sewing machine and then automatically pushing it by first thrust means up to a first rectilinear abutment which is parallel to and slightly beyond said sewing line;

b. once that side of the corner of said first piece along which sewing is to take place has been positioned against the first abutment, automatically displacing said first piece by pressing first displacement means against the piece and sliding it over the first slide surface in a direction parallel to the sewing line until the other side of the corner in the first piece has reached a predetermined reference line;

c. manually placing a second piece of fabric on a second slide surface lying in a plane parallel to and above that of the first slide surface and then automatically pushing said second piece by second thrust means until it reaches a second rectilinear abutment situated in the same vertical plane as the first abutment;

d. once that side of the corner of the second piece along which sewing is to taken place has been positioned against the second abutment, automatically displacing said second piece by pressing second displacement means against the piece and sliding it over the second slide surface in a direction parallel to the sewing line until the other side of the corner in the second piece has reached the predetermined reference line; and e. automatically simultaneously displacing the superposed first and second pieces by means of said first and second displacement means to insert them under the presser foot of said sewing machine.

2. Apparatus for automatically aligning all the corner edge of two pieces of fabric and inserting them in a sewing machine having a working plane and a presser foot for sewing of said pieces along a sewing line comprising:

a. a first slide plate having a slide surface which is coplanar with the working plane of the sewing machine and a first rectilinear abutment on said first slide plate parallel to said sewing line and located slightly beyond said line;

b. a second slide plate having a slide surface in a plane parallel to and above the plane of said first plate slide surface and a second rectilinear abutment on said second slide plate in the same vertical plane as said first abutment;

c. respective thrust means associated with each of said slide surfaces, each of said thrust means operable to displace a respective one of said pieces of fabric into engagement with the corresponding abutment whereby the two superimposed edges parallel to the line of stitching are aligned; and d. respective sets of displacement means for selectively individually displacing each of said pieces of fabric by sliding said pieces of fabric respectively over the bottom and top faces of the second slide plate initially up to a reference line whereby the two superimposed edges substantially transverse to the line of stitching are aligned and subsequently simultaneously displacing said aligned pieces up to said sewing machine presser foot.

3. Apparatus according to claim 2, wherein the thrust means are pneumatic means comprising nozzles fed with compressed air and inclined in the direction along which the piece of fabric is to be thrust.

4. Apparatus according to claim 2, wherein each set of displacement means comprises:

a. a dog;

b. a dog drive device capable of communicating thereto both a vertical motion between a first position in which the dog is at a distance from the second slide plate and a second position in which the dog is in contact with said plate, and a horizontal motion along the direction of the sewing line; and c. means for detecting a piece of fabric as it moves over the second slide plate, said means acting on the drive device in such a manner as to prevent it from driving the piece of fabric any further once its corresponding side has reached the reference line.

5. Apparatus according to claim 4, wherein each drive device is connected to synchronizing means for causing both dogs to move simultaneously and at the same speed along the direction of the sewing line through a distance equal to the distance between the reference line and the underside of the presser foot of the sewing machine.

6. Apparatus according to claim 2, including a third side plate extending substantially parallel to the working plane and situated above the second slide plate, and wherein the thrust means comprise orifices through the first slide plate and through said third slide plate.

7. Apparatus according to claim 6, wherein the first and third slide plates are slotted to allow the corresponding dog to pass therealong as it moves horizontally in the direction of the sewing line.

* * * * *